US008847824B2

(12) United States Patent
Kotter et al.

(10) Patent No.: US 8,847,824 B2
(45) Date of Patent: Sep. 30, 2014

(54) APPARATUSES AND METHOD FOR CONVERTING ELECTROMAGNETIC RADIATION TO DIRECT CURRENT

(75) Inventors: Dale K. Kotter, Shelley, ID (US); Steven D. Novack, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 226 days.

(21) Appl. No.: 13/426,407

(22) Filed: Mar. 21, 2012

(65) Prior Publication Data

US 2013/0249771 A1 Sep. 26, 2013

(51) Int. Cl.
*H01Q 1/38* (2006.01)

(52) U.S. Cl.
USPC ..... 343/700 MS; 343/795

(58) Field of Classification Search
CPC ..... H01Q 1/248; H01Q 21/061; H02N 6/00
USPC ..... 343/700 MS, 748, 702, 846, 795
See application file for complete search history.

(56) References Cited

U.S. PATENT DOCUMENTS

| | | | |
|---|---|---|---|
| 4,360,741 | A | 11/1982 | Fitzsimmons et al. |
| 4,445,050 | A | 4/1984 | Marks |
| 4,720,642 | A | 1/1988 | Marks |
| 5,043,739 | A | 8/1991 | Logan et al. |
| 5,313,216 | A | 5/1994 | Wang |
| 5,381,157 | A | 1/1995 | Shiga |
| 5,436,453 | A | 7/1995 | Chang et al. |
| 5,712,647 | A | 1/1998 | Shively |
| 5,773,831 | A | 6/1998 | Brouns |
| 6,289,237 | B1 | 9/2001 | Mickle et al. |
| 6,295,029 | B1 | 9/2001 | Chen |
| 6,373,447 | B1 | 4/2002 | Rostoker et al. |
| 6,396,450 | B1 | 5/2002 | Gilbert |
| 6,534,784 | B2 | 3/2003 | Eliasson et al. |
| 6,756,649 | B2 | 6/2004 | Moddel et al. |
| 6,856,291 | B2 | 2/2005 | Mickle et al. |

(Continued)

FOREIGN PATENT DOCUMENTS

| | | |
|---|---|---|
| WO | WO 2004/093497 | 10/2004 |
| WO | 2012150599 | 11/2012 |

OTHER PUBLICATIONS

PCT International Search Report and Written Opinion of the International Searching Authority for PCT/US2013/021392, dated Apr. 2, 2013, 10 pages.

(Continued)

*Primary Examiner* — Hoanganh Le
(74) *Attorney, Agent, or Firm* — TraskBritt

(57) ABSTRACT

An energy conversion device may include a first antenna and a second antenna configured to generate an AC current responsive to incident radiation, at least one stripline, and a rectifier coupled with the at least one stripline along a length of the at least one stripline. An energy conversion device may also include an array of nanoantennas configured to generate an AC current in response to receiving incident radiation. Each nanoantenna of the array includes a pair of resonant elements, and a shared rectifier operably coupled to the pair of resonant elements, the shared rectifier configured to convert the AC current to a DC current. The energy conversion device may further include a bus structure operably coupled with the array of nanoantennas and configured to receive the DC current from the array of nanoantennas and transmit the DC current away from the array of nanoantennas.

25 Claims, 5 Drawing Sheets

(56) References Cited

U.S. PATENT DOCUMENTS

| | | | |
|---|---|---|---|
| 6,870,511 | B2 | 3/2005 | Lynch |
| 6,870,517 | B1 | 3/2005 | Anderson |
| 6,882,128 | B1 | 4/2005 | Rahmel |
| 6,885,355 | B2 | 4/2005 | Killen |
| 6,900,763 | B2 | 5/2005 | Killen |
| 6,911,957 | B2 | 6/2005 | Brown |
| 6,924,688 | B1 | 8/2005 | Beigel |
| 6,965,353 | B2 | 11/2005 | Shirosaka et al. |
| 6,965,355 | B1 | 11/2005 | Durham |
| 6,977,615 | B2 | 12/2005 | Brandwein, Jr. |
| 6,995,733 | B2 | 2/2006 | Waltho |
| 7,057,514 | B2 | 6/2006 | Mickle et al. |
| 7,068,225 | B2 | 6/2006 | Schantz |
| 7,070,406 | B2 | 7/2006 | Jeans |
| 7,071,889 | B2 | 7/2006 | McKinzie, III et al. |
| 7,083,104 | B1 | 8/2006 | Empedocles et al. |
| 7,084,605 | B2 | 8/2006 | Mickle et al. |
| 7,088,306 | B2 | 8/2006 | Chiang et al. |
| 7,119,161 | B2 | 10/2006 | Lawandy |
| 7,190,315 | B2 | 3/2007 | Waltho |
| 7,190,317 | B2 | 3/2007 | Werner et al. |
| 7,190,326 | B2 | 3/2007 | Voeltzel |
| 7,228,156 | B2 | 6/2007 | Gilbert |
| 7,250,921 | B1 | 7/2007 | Henry |
| 7,253,426 | B2 | 8/2007 | Gorrell et al. |
| 7,256,753 | B2 | 8/2007 | Werner et al. |
| 7,329,871 | B2 | 2/2008 | Fan et al. |
| 7,436,373 | B1 | 10/2008 | Lopes et al. |
| 7,486,236 | B2 | 2/2009 | Sarehraz et al. |
| 7,792,644 | B2 | 9/2010 | Kotter et al. |
| 8,071,931 | B2 | 12/2011 | Novack et al. |
| 2002/0171078 | A1 | 11/2002 | Eliasson et al. |
| 2003/0034918 | A1 | 2/2003 | Werner et al. |
| 2003/0079772 | A1 | 5/2003 | Gittings et al. |
| 2003/0142036 | A1 | 7/2003 | Wilhelm et al. |
| 2003/0214456 | A1 | 11/2003 | Lynch |
| 2003/0230747 | A1 | 12/2003 | Ostergard |
| 2004/0028307 | A1 | 2/2004 | Diduck |
| 2004/0201526 | A1 | 10/2004 | Knowles et al. |
| 2005/0057431 | A1 | 3/2005 | Brown |
| 2005/0247470 | A1 | 11/2005 | Fleming et al. |
| 2005/0253763 | A1 | 11/2005 | Werner et al. |
| 2006/0035073 | A1 | 2/2006 | Funkenbusch et al. |
| 2006/0061510 | A1 | 3/2006 | Itsuji |
| 2006/0092087 | A1 | 5/2006 | Lange |
| 2006/0125707 | A1 | 6/2006 | Waschenko |
| 2006/0194022 | A1 | 8/2006 | Boutilier et al. |
| 2006/0227422 | A1 | 10/2006 | Monacelli et al. |
| 2006/0231625 | A1 | 10/2006 | Cumming |
| 2006/0267856 | A1 | 11/2006 | Voeltzel |
| 2007/0077688 | A1 | 4/2007 | Hsu et al. |
| 2007/0132645 | A1 | 6/2007 | Ginn et al. |
| 2007/0159395 | A1 | 7/2007 | Sievenpiper et al. |
| 2007/0170370 | A1 | 7/2007 | Gorrell et al. |
| 2007/0171120 | A1 | 7/2007 | Puscasu et al. |
| 2007/0176832 | A1 | 8/2007 | Qian et al. |
| 2007/0235658 | A1 | 10/2007 | Zimdars et al. |
| 2007/0240757 | A1 | 10/2007 | Ren et al. |
| 2008/0290822 | A1 | 11/2008 | Greene et al. |
| 2009/0121014 | A1 | 5/2009 | Tharp et al. |
| 2010/0001587 | A1 | 1/2010 | Casey et al. |
| 2010/0284086 | A1 * | 11/2010 | Novack et al. ..... 359/580 |
| 2011/0017284 | A1 | 1/2011 | Moddel |
| 2011/0163920 | A1 | 7/2011 | Cutler |
| 2011/0194100 | A1 | 8/2011 | Thiel et al. |
| 2011/0277805 | A1 | 11/2011 | Novack et al. |
| 2012/0080073 | A1 | 4/2012 | Kotter et al. |

OTHER PUBLICATIONS

Bailey, R. L. (1972). A proposed new concept for a solar-energy converter. Journal of Engineering for Power (73).

Beck et al., "Microstrip antenna coupling for quant-well infrared photodetectors," 2001, Infrared Physics and Technology, vol. 42, pp. 189-298.

Berland, B. (2003). Photovoltaic Technologies Beyond the Horizon: Optical Rectenna Solar Cell. Final report, NREL Report No. SR-520-33263.

Blackburn et al., Numerical Convergence in Periodic Method of Moments Analysis of Frequency-Selective Surfaces Based on Wire Elements, Aug. 6, 2004, IEEE, vol. 53, No. 10, pp. 3308-3315.

Brown, W. (1984). The History of Power Transmission by Radio Waves. Microwave Theory and Techniques, IEEE Transactions on , 32 (9), 1230-1242.

Brown, E. R. (2004). A System Level Analysis of Schottky diodes for incoherent THz imaging arrays. Solid State Electronics(p. 2051) vol. 48, Issue 10-11, International Semiconductor Device Research Symposium 2003.

Brown, W. (1976). Optimization of the Efficiency and Other Properties of the Rectenna Element., (pp. 142-144).

Corkish, R., Green, M. A., & Puzzer, T. (2002). Solar energy collection by antennas. Solar Energy , 73 (6), 395-401.

Dagenais, M., Choi, K., Yesilkoy, F., Chryssis, A. N., & Peckerar, M. C. (2010). Solar spectrum rectification using nano-antennas and tunneling diodes. In L. A. Eldada, & E.-H. Lee (Ed.), Proc. of SPIE. 7605, p. 76050E. SPIE.

Dale K. Kotter, Steven D. Novack, W. Dennis Slafer, and Patrick Pinhero, "Solar Nantenna Electromagnetic Collectors," ASME Conference Proceedings, vol. 2008, No. 43208, pp. 409-415, 2008.

Denholm, Paul, Drury, Easan, Margolis, Robert, "The Solar Deployment System (SolarDS) Model: Documentation and Sample Results," Technical Report NREL/TP-.6A2-45832, Sep. 2009.

Eliasson, B. J. (2001). Metal-Insulator-Metal Diodes for Solar Energy Conversion. PhD Thesis, University of Colorado at Boulder, Boulder.

Frost, Greg, "BC physicists transmit visible light through miniature cable," Boston college, Public release, Jan. 8, 2007, 2 pages.

Fumeaux, C. Hellmann, W., et al. (1998). Nanometer thin-film Ni—NiO—Ni diodes for detection and mixing of 30 THz radiation. Infrared Physics & Technology, 39 (123-189).

Gates et al., "Unconventional Nanofabrication," Annu. Rev. Mater. Res. 2004, 34:339-72.

Gonzalez, F., & Boreman, G. D. (2005). Comparison of dipole, bowtie, spiral and log-periodic IR antennas. Infrared Physics & Technology , 46 (5), 418-428.

Goswami, D.Y., Vijayaraghavan, S., Lu, S., & Tamm, G. (2004). New and emerging developments in solar energy. Solar Energy , 76 (1-3), 33-43.

Grover, S., Dmitriyeva, 0., Estes, M. J., & Moddel, G. (2010). Traveling-Wave Metal/Insulator/Metal Diodes for Improved Infrared Bandwidth and Efficiency of Antenna-Coupled Rectifiers. Nanotechnology, IEEE Transactions on, 9 (6), 716-722.

Hartman, T. E. (1962). Tunneling of a Wave Packet. J. Appl. Phys. , 33 (12), 3427-3433.

Hooberman, Benjamin, "Everything You Ever Wanted to Know About Frequency-Selective Surface Filters but Were Afraid to Ask," May 2005, pp. 1-22.

International Search Report from PCT/US08/83142 dated Jan 9. 2009, 2 pages.

International Search Report from PCT/US08/83143 dated Jan. 9, 2009, 2 pages.

Jonietz, Erika, "Nano Antenna," Technology Review, <<http://www.technologyreview.com/Nanotech/16024/>> Dec. 2005, 5 pages.

Kale, B. M. (1985). Electron tunneling devices in optics. Optical Engineering , 24 (2), 267-274.

Kazemi, H., Shinohara, K., Nagy, G., Ha, W, Lail, B., Grossman, E., et al. (2007). First THz and IR characterization of nanometer-scaled antenna-coupled InGaAs/InP Schottky-diode detectors for room temperature infrared imaging, SPEI, 2007, vol. 6542, 4 pages.

Kwon et al., "Efficient Method of Moments Formulation for Large PEC Scattering Problems Using Asymptotic Phasefront Extraction (APE)," IEEE Transaction on Antennas and Propagation, vol. 49, No. 4, Apr. 2001, pp. 583-591.

Landsberg, P. T. and Baruch, P. (1989). The Thermodynamics of the conversion of radiation energy in photovotaics. J. Phys., 1911-1926.

Matsumoto, Y., Hanajiri, T., Toyabe, T., .& Sugano, T. (1996). Single Electron Device with Asymmetric Tunnel Barriers. Jpn. J. Appl. Phys. , 35, 1126-1131.

(56) References Cited

OTHER PUBLICATIONS

Mayer, A., Chung, M. S., Weiss, B. L., Miskovsky, N. M., & Cutler, P. H. (2010). Simulations of infrared and optical rectification by geometrically asymmetric metalae'vacuumaemetal junctions for applications in energy conversion devices. Nanotechnology , 21 (14), 145204.
Monacelli et al., "Infrared Frequency Selective Surface Based on Circuit-Analog Square Loop Design," IEEE Transactions on Antennas and Propagation, vol. 53, No. 2, Feb. 2005, pp. 745-752.
Monacelli et al., "Infrared frequency selective surfaces: design, fabrication and measurement," SPIE Infrared Technology and Applications XXX conference, Apr. 12-16, 2004, vol. 5406, pp. 879-886.
Nagae, M. (1972). Response Time of Metal-Insulator-Metal Tunnel Junctions. Jpn. J. Appl. Phys. , 11 (11), 1611-1621.
Nanotechnology and Nanomaterials News Database, "Sunlight Antenna for Solar Cells is Focus of Research Agreement," <<www.perfectdisplay.com>> Jun. 10, 2005, 1 page.
Nanotechnology News, "Carbon Nanotube Structures Could Provide More Efficient Solar Power for Soldiers," <<http://www.azonano.com/news.asp?newsID=548>> Jun. 13, 2007, 4 pages.
Nanowerk Spotlight, "Optical antenna with a single carbon nanotube," <<http://www.nanowerk.com/spotlight/spotid=1442.php>> Jun. 13, 2007, 3 pages.
News in Science, "Light excites nano-antenna," <<http://www.abc.net.au/science/news/stories/s1202875.htm>> Sep. 20, 2004, 2 pages.
Osgood, R. M., Kimball, B. R., & Carlson, J. (2007). Nanoantenna-coupled MIM nanodiodes for efficient vis/nir energy conversion. In D. R. Myers (Ed.). 6652, p. 665203. SPIE.
Panteny et al., The Frequency Dependent Permittivity and AC Conductivity of Random Electrical Networks, 2005, Ferroelectrics, 319, pp. 199-208.
Peters et al., "Method of Moments Analysis of Anisotropic Artificial Media Composed of Dielectric Wire Objects," IEEE Transactions on Microwave Theory and Techniques, vol. 43, No. 9, Sep. 1995, pp. 2023-2027.
Peters, Timothy J., "A Quasi-Interactive Graded-Mesh Generation Algorithm for Finite Element/Moment Method Analysis on NURBS-Based Geometries," IEEE 1994, pp. 1390-1393.
Pierantoni et al., "Theoretical and Numerical Aspects of the Hybrid MOM-FDTD, TLM-IE and ARB Methods for the Efficient Modelling of EMC Problems," 29th European Microwave Conference—Munich 1999, pp. 313-316.
Rahmat-Sammii et al., "Mesh Reflector Antennas with Complex Weaves: PO/Periodic MoM and Equivalent Strip Width Verification," IEEEAC paper #1547, Version 3, Updated Dec. 3, 2006, pp. 1-9.
Research Highlights, "Catching the sun's rays with wire," DOE Pulse, No. 242, Aug. 27, 2007 (p. 2).
Rockwell, S., Lim, D., Bosco, B., Baker, J., Eliasson, B., Forsyth, K., et al. (2007). Characterization and Modeling of Metal/Double-Insulator/Metal Diodes for Millimeter Wave Wireless Receiver Applications. Radio Frequency Integrated Circuits (RFIC) Symposium, IEEE, (pp. 171-174).
Sarehraz, M., Buckle, K., Weller, T., Stefanakos, E., Bhansali, S., Goswami, Y., et al. (2005). Rectenna developments for solar energy collection., (pp. 78-81).
Sarehraz, M. (2005). Novel rectenna for collection of infrared and visible radiation. PhD Thesis, University of South Florida.
Shafer, Rachel, "Thermoelectrics: A matter of material," Innovations—Research and News from Berkeley Engineering. vol. 4, Issue 5, Jun. 2010.
Strassner, B. H., & Chang, K. (2005). Rectifying Antennas (Rectennas). In Encyclopedia of RF and Microwave Engineering (p. 4418). John Wiley & Sons.
Sanchez, A., Davis, C. F., Liu, K. C., & Javan, A. (1978). The MOM tunneling diode: Theoretical estimate of its performance at microwave and infrared frequencies. J. Appl. Phys. , 49 (10), 5270-5277.
Science Daily, "A Sound Way to Turn Heat Into Electricity," <<http://www.sciencedaily.com/releases/2007/06/070603225026.htm>> Jun. 13, 2007, 3 pages.
Wang et al., "Receiving and transmitting light-like radio waves: Antenna effect in arrays of aligned carbon nanotubes," Applied Physics Letters, vol. 85, No. 13, Sep. 27, 2004, pp. 2607-2609.
Written Opinion of the International Searching Authority from PCT/US08/83142 dated Jan. 9, 2009, 6 pages.
Written Opinion of the International Searching Authority from PCT/US08/83143 dated Jan. 9, 2009, 7 pages.
International Preliminary Report on Patentability for International Application No. PCT/US08/83143 dated May 18, 2010.
International Preliminary Report on Patentability for International Application No. PCT/US08/83142 dated May 18, 2010.
Oliveria et al. Analysis of Mocrostrip antenna array with GaAS and fenolite substrated, 2002, IEEE infrared and millimeter waves conference Digest, pp. 91-92.
"$1/W Photovoltaic Systems, A White Paper to Explore a Grand Challenge for Electricity from Solar," U.S. Department of Energy, 2010.
Huo. A Terahertz Radiation Detection System Design and Device Modeling. 2003. [retrieved on Dec. 30, 2013]. Retrieved from ProQuest Dissertations and Theses: <URL:http://search.proquest.com/docview/305342595/fulltextPDF/142AC395157 4EAC6EE0/4? accountid=142944>. pp. 1-220.
Kotter, Dale K., et al., "Lithographic Antennas for Enhancement of Solar-Cell Efficiency," Published Apr. 1998, 26 pages.
PCT International Search Report and Written Opinion of the International Searching Authority for PCT/US2013/049932, dated Jan. 31, 2014, 10 pages.
US 2007/0077401 A1, 04/2007, Pinto (withdrawn)

* cited by examiner

APPARATUSES AND METHOD FOR CONVERTING ELECTROMAGNETIC RADIATION TO DIRECT CURRENT

GOVERNMENT RIGHTS

This invention was made with government support under Contract Number DE-AC07-05ID14517 awarded by the United States Department of Energy. The government has certain rights in the invention.

CROSS-REFERENCE TO RELATED APPLICATIONS

This application is related to U.S. patent application Ser. No. 13/311,874, filed Dec. 6, 2011, now U.S. Pat. No. 8,338,772, issued Dec. 25, 2012, which is a continuation of U.S. patent application Ser. No. 11/939,342, filed Nov. 13, 2007, now U.S. Pat. No. 8,071,931, issued Dec. 6, 2011. This application is also related to U.S. patent application Ser. No. 13/179,329, filed Jul. 8, 2011, now U.S. Pat. No. 8,283,619, issued Oct. 9, 2012, which is a divisional of U.S. patent application Ser. No. 11/939,342, filed Nov. 13, 2007, now U.S. Pat. No. 8,071,931, issued Dec. 6, 2011. The disclosures of each of the above-referenced applications are incorporated by reference herein in their entireties.

FIELD

Embodiments of the present disclosure relate to energy conversion devices and systems and methods of forming such devices and systems. In particular, embodiments of the present disclosure relate to energy conversion devices and systems with resonance elements and a shared rectifier.

BACKGROUND

Energy harvesting techniques and systems are generally focused on renewable energy such as solar energy, wind energy, and wave action energy. Solar energy is conventionally harvested by arrays of solar cells, such as photovoltaic cells, that convert radiant energy to direct current (DC) power. Such radiant energy collection is limited in low-light conditions, such as at night or even during cloudy or overcast conditions. Conventional solar technologies are also limited with respect to the locations and orientations of installment. For example, conventional photovoltaic cells are installed such that the sunlight strikes the photovoltaic cells at specific angles such that the photovoltaic cells receive relatively direct incident radiation. Expensive and fragile optical concentrators and mirrors are conventionally used to redirect incident radiation to the photovoltaic cells to increase the efficiency and energy collection of the photovoltaic cells. Multi-spectral bandgap-engineered materials and cascaded lattice structures have also been incorporated into photovoltaic cells to improve efficiency, but these materials and structures may be expensive to fabricate. Multiple-reflection and etched-grating configurations have also been used to increase efficiency. Such configurations, however, may be complex and expensive to produce, and may also reduce the range of angles at which the solar energy can be absorbed by the photovoltaic cells.

Additionally, conventional photovoltaic cells are relatively large. As a result, the locations where the photovoltaic cells can be installed may be limited. As such, while providing some utility in harvesting energy from the electromagnetic radiation provided by the sun, current solar technologies are not yet developed to take full advantage of the potential electromagnetic energy available. Further, the apparatuses and systems used in capturing and converting solar energy are not particularly amenable to installation in numerous locations or situations.

Turning to another technology, frequency selective surfaces (FSSs) are used in a wide variety of applications, including radomes, dichroic surfaces, circuit analog absorbers, and meanderline polarizers. An FSS is a two-dimensional periodic array of metal elements to form an RLC circuit. For example, an FSS may include electromagnetic antenna elements. Such antenna elements may be in the form of, for example, conductive dipoles, loops, patches, slots or other antenna elements. An FSS structure generally includes a metallic grid of antenna elements deposited on a dielectric substrate. Each of the antenna elements within the grid defines a receiving unit cell.

An electromagnetic wave incident on the FSS structure will pass through, be reflected by, or be absorbed by the FSS structure. This behavior of the FSS structure generally depends on the electromagnetic characteristics of the antenna elements, which can act as small resonance elements. As a result, the FSS structure can be configured to perform as low-pass, high-pass, or dichroic filters. Thus, the antenna elements may be designed with different geometries and different materials to generate different spectral responses.

Conventionally, FSS structures have been successfully designed and implemented for use in radio frequency (RF) and microwave frequency applications. As previously discussed, there is a large amount of renewable electromagnetic radiation available that has been largely untapped as an energy source using currently available techniques. For instance, radiation in the ultraviolet (UV), visible, and infrared (IR) spectra are energy sources that show considerable potential. However, the scaling of existing FSS structures or other similar structures for use in harvesting such potential energy sources comes at the cost of reduced gain for given frequencies. For example, nano-scale resonant elements (also referred to as nanoantennas and nantennas) have experienced substantial impedance mismatch causing less than 1% power transfer, limiting the usefulness of such devices.

Scaling FSS structures or other transmitting or receptive structures for use with, for example, the IR or near-IR spectra also presents numerous challenges due to the fact that materials do not behave in the same manner at the nano-scale as they do at scales that enable such structures to operate in, for example, the radio frequency (RF) spectrum. For example, materials that behave homogeneously at scales associated with the RF spectrum often behave non-homogeneously at scales associated with the IR or near-IR spectra.

DETAILED DESCRIPTION

In the following detailed description, reference is made to the accompanying drawings which form a part hereof, and in which is shown by way of illustration specific embodiments of the present disclosure. These embodiments are described with specific details to clearly describe the embodiments of the present disclosure. However, the description and the specific examples, while indicating examples of embodiments of the present disclosure, are given by way of illustration only and not by way of limitation. Other embodiments may be utilized and changes may be made without departing from the scope of the disclosure. Various substitutions, modifications, additions, rearrangements, or combinations thereof may be made and will become apparent to those of ordinary skill in the art. In addition, features from one embodiment may be combined with features of another embodiment while still being encompassed within the scope of the disclosure as contemplated by the inventors.

It should be understood that any reference to an element herein using a designation such as "first," "second," and so forth, does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed or that the first element must precede the second element in some manner. In addition, unless stated otherwise, a set of elements may comprise one or more elements.

Embodiments of the present invention provide methods, apparatuses, and systems for converting and harvesting energy from electromagnetic radiation, including, for example, electromagnetic radiation in the infrared, near-infrared and visible light spectra. Such apparatuses may include energy conversion devices, energy harvesting devices, frequency selective structures, energy storage devices, nanoantenna electromagnetic concentrators (NECs), and other nanoantenna coupled devices.

Embodiments of the present disclosure further provide integrated antennas and rectifiers that convert the solar energy induced terahertz (THz) electromagnetic currents to DC power. The integrated antennas and rectifiers may further transmit the DC power from the arrays of nanoantennas for energy harvesting. In contrast to conventional methods employing rectifier devices that couple directly with a single nanoantenna, embodiments of the present disclosure may further include neighboring antennas that share a common rectifier to further provide flexibility by tuning the resonant frequency of the structure and reducing impedance mismatch.

Figure 1:
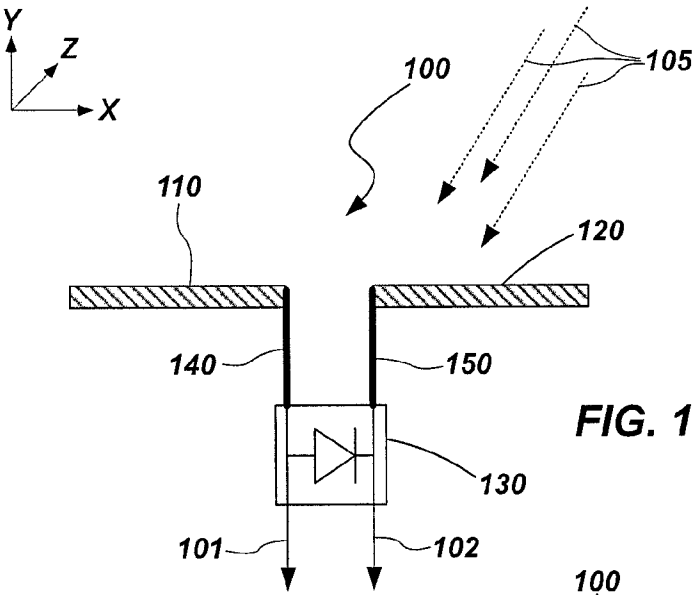
FIG. 1 is a schematic diagram for a side view of a resonant element that may be used in an energy conversion device.

FIG. 1 is a schematic diagram for a side view of a resonant element 100 that may be used in an energy conversion device. The resonant element 100 may include conductive elements 110, 120 coupled with a rectifier 130. The resonant element 100 may be configured to generate an alternating current (AC current) signal in response to incident radiation 105. In other words, the resonant element 100 may be configured to generate the AC current responsive to incident radiation 105.

The resonant element 100 may exhibit a particular resonant frequency. For example, the resonant frequency may be determined, in part, by the size, shape, and spacing of components of the resonant element 100, and by properties of the particular conductive material forming the resonant element 100. In other words, the characteristics (e.g., geometry, materials used, etc.) of the resonant element 100 may be selected such that the resonant element 100 is tuned to resonate for a particular resonant frequency. At optical frequencies, the skin depth of an electromagnetic wave in metals may be just a few nanometers, resulting in the resonant element 100 having dimensions in the nanometer range. For example, the skin depth may be between 10 nm and 20 nm for surface plasmons; however, such dimensions may vary depending on the thickness of the resonant element 100 and the frequency of the incident radiation 105. Because of these dimensions and structure, such a resonant element 100 may be referred to as an antenna, nanoantenna, nantenna, and other similar terms.

The resonant element 100 may be configured such that the resonant element 100 exhibits a resonant frequency in the THz range. As a result, incident radiation 105 having frequencies in the THz range may excite surface current waves in the conductive elements 110, 120. Such surface current waves may also have a frequency of approximately the resonant frequency of the resonant element 100. These surface current waves may also be referred to herein as AC current. To reduce transmission losses, the AC current may be substantially immediately rectified (e.g., less than several microns away) by the rectifier 130 to convert the AC current to DC current. The rectifier 130 may include a diode or other PN material. For example, the rectifier 130 may include a metal-insulator-insulator-metal (MIIM) diode, a metal-insulator-metal (MIM) diode, a metal-semiconductor junction (Schottky) diode, a Gunn diode (e.g., GaAs or InP), a photodiode, a PIN diode (i.e., diode having a P-type region, an insulator region, and an N-type region), and a light-emitting diode (LED). Some embodiments may include geometric diodes, an example of which is described in U.S. Patent Application Publication No. 2011/0017284, filed Jul. 17, 2009, and entitled "Geometric Diode, Applications and Method." Some embodiments may include a PN semiconductor material (i.e., a semiconductor material having a P-type region and an N-type region).

The location of the rectifier 130 may be referred to as the feedpoint for the AC current to flow for being transferred to the rectifier 130 for conversion to a DC current. The AC current may exhibit a sinusoidal frequency of between $10^{12}$ and $10^{14}$ hertz. The high efficient transmission of electrons along a wire may be accomplished through the use of one or more strip transmission lines (striplines) 140, 150 that may be specifically designed for high speed and low propagation loss. The DC current may be provided to an energy storage device (e.g., capacitor, carbon nanotube, battery, etc.) for harvesting. An energy storage device may be separate from the resonant element 100 or may be directly integrated into the monolithic antenna structure.

As shown, the resonant element 100 may be configured as a dipole antenna. For example, the resonant element 100 includes two conductive elements 110, 120. The conductive elements 110, 120 may be collinear with each other having a space therebetween. Each of the conductive elements 110, 120 may be coupled with the rectifier 130 through the striplines 140, 150. For example, the first conductive element 110 may be coupled with an anode of the rectifier 130 through the first stripline 140, and the second conductive element 120 may be coupled with a cathode of the rectifier 130 through the second stripline 150. The striplines 140, 150 may be coplanar with each other; however, the striplines 140, 150, are perpendicular to the direction of the conductive elements 110, 120 and an underlying substrate (not shown, but present in the direction of arrows 101, 102) upon which the resonant element 100 is formed. In other words, the conductive elements 110, 120 are parallel with the underlying substrate in the XZ plane, with the striplines 140, 150 extending in the Y-direction therebetween. As a result, the striplines 140, 150 are perpendicular to the conductive elements 110, 120 and the underlying substrate, with the rectifier 130 being positioned therebetween. Therefore, the striplines 140, 150 and rectifier 130 shown in FIG. 1 are offset below the conductive elements 110, 120 and are not co-planar with the conductive elements 110, 120.

Figure 2:
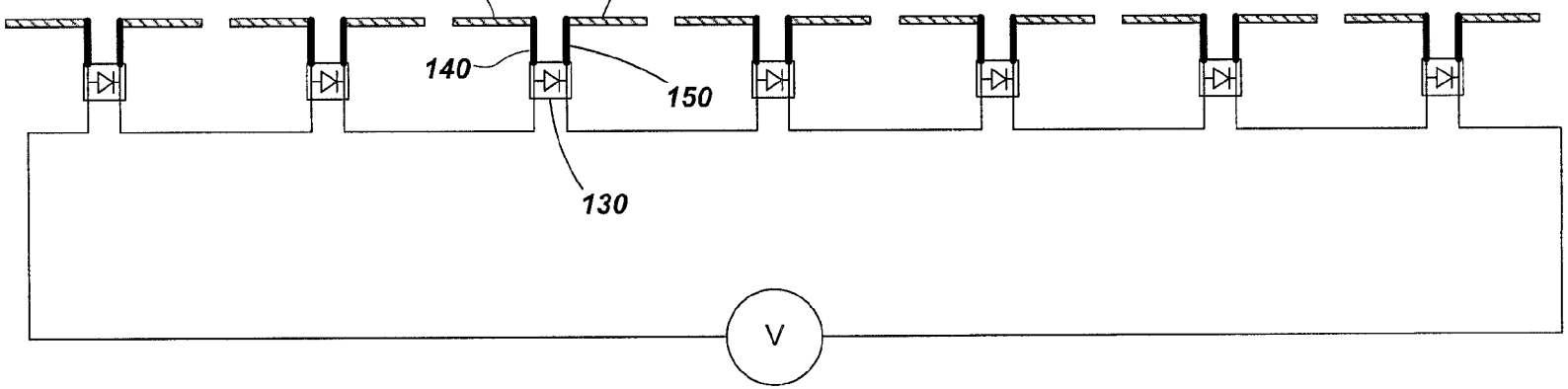
FIG. 2 is a schematic diagram for a side view of an energy conversion device that includes a plurality of resonant elements as described with reference to FIG. 1.

FIG. 2 is a schematic diagram of a side view of an energy conversion device 200 that includes a plurality of resonant elements 100 as described with reference to FIG. 1. Each of the plurality of resonant elements 100 may include conductive elements 110, 120 configured as a dipole antenna coupled with striplines 140, 150 to a rectifier 130 at a feedpoint. As shown in FIG. 2, the outputs of each of the rectifiers 130 may be DC coupled together. For example, the rectifiers 130 may be interconnected in series, resulting in a summation of DC voltage (V), which may enable the use of a common power bus for energy harvesting.

One challenge of conventional nanoantennas is that nanoantennas have had difficulty scaling down without a large loss in power for the high (e.g., THz) frequencies exhibited by the incident radiation 105. Embodiments of the present disclosure include apparatuses and methods that are configured to improve impedance matching between the nanoantenna and the rectifier.

Figure 3A:
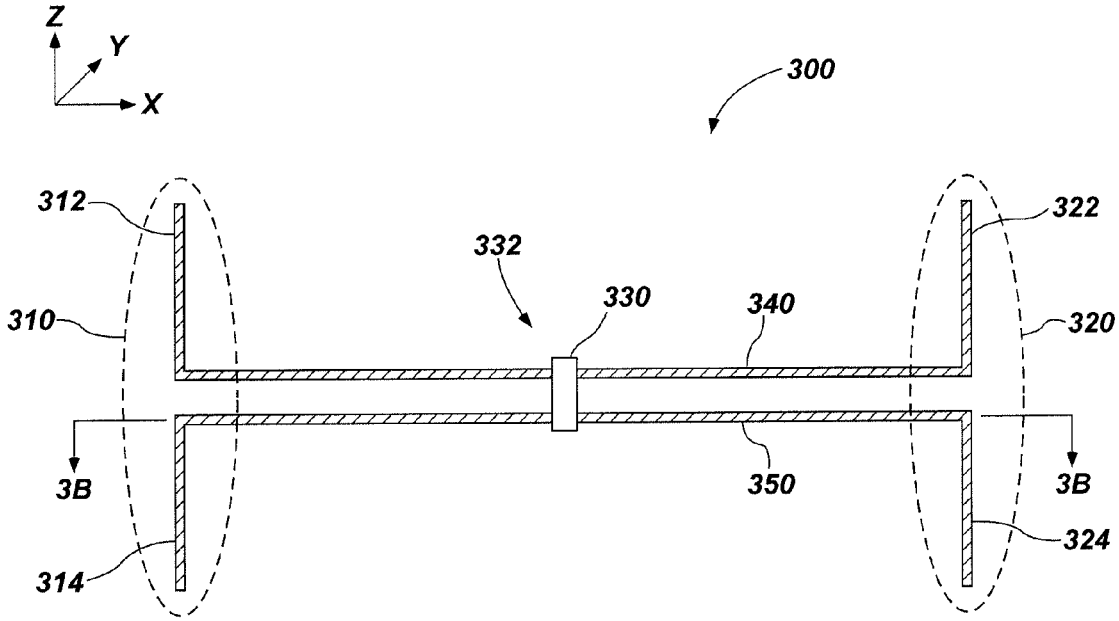
FIG. 3A is a top view of an energy conversion device according to an embodiment of the present disclosure.

FIG. 3A is a top view of an energy conversion device 300 according to an embodiment of the present disclosure. The energy conversion device 300 may also be referred to as an energy harvesting device in configurations that include harvesting and storage of the energy generated thereby. The energy conversion device 300 includes a plurality of neighboring antennas 310, 320 coupled together with at least one stripline 340, 350 therebetween. The at least one stripline 340, 350 may also be coupled with a common rectifier 330. In other words, the plurality of neighboring antennas 310, 320 may share a common rectifier 330. The location of the common rectifier 330 may be referred to as the feedpoint 332 for both antennas 310, 320 because the AC current for each of the antennas 310, 320 flow thereto for rectification.

In the example shown in FIG. 3A, each of the pair of antennas 310, 320 are dipole antennas. For example, the first antenna 310 is a dipole antenna having two conductive elements 312, 314, and the second antenna 320 is a dipole antenna having two conductive elements 322, 324. The conductive elements 312, 314 may be elongated conductive elements and collinear with each other having a space therebetween. Likewise, the conductive elements 322, 324 may be elongated conductive elements and collinear with each other having a space therebetween. The at least one stripline 340, 350 may include two co-planar striplines 340, 350. The first stripline 340 may couple the first conductive element 312 of the first antenna 310 with the first conductive element 322 of the second antenna 320. The second stripline 350 may couple the second conductive element 314 of the first antenna 310 with the second conductive element 324 of the second antenna 320. The rectifier 330 may be coupled with each of the co-planar striplines 340, 350. As a result, the feedpoint 332 may be located along the length of the co-planar striplines 340, 350.

The antennas 310, 320 and the striplines 340, 350 may be formed of an electrically conductive material. The electrically conductive material may include, for example, one or more of niobium (Nb), manganese (Mn), gold (Au), silver (Ag), copper (Cu), aluminum (Al), platinum (Pt), nickel (Ni), iron (Fe), lead (Pb), and tin (Sn), or any other suitable electrically conductive material. In one embodiment, the conductivity of the electrically conductive material used to form the antennas 310, 320 may be from approximately $1.0\times10^6$ $Ohms^{-1}$-$cm^{-1}$ to approximately $106.0\times10^6$ $Ohms^{-1}$-$cm^{-1}$.

Each of the pair of antennas 310, 320 may be configured to generate an AC current responsive to incident radiation 105 (FIG. 1). Each of the pair of antennas 310, 320 may exhibit a particular resonant frequency. For example, the resonant frequency may be determined, in part, by the size, shape, and spacing of the antennas 310, 320, and by properties of the particular conductive material forming the antennas 310, 320. In other words, the characteristics (e.g., geometry, materials used, etc.) of the antennas 310, 320 may be selected such that the antennas 310, 320 may be tuned to resonate for a particular resonant frequency (e.g., in the THz range).

The rectifier 330 may be configured to rectify the AC current induced in the pair of antennas 310, 320 responsive to the incident radiation 105 (FIG. 1). As a result, the rectifier 330 may generate DC power. The rectifier 330 may include a diode or set of diodes in a bridge configuration. In one embodiment, the diode may be an MIIM diode. The MIIM diode may include a first metal layer (e.g., Nb), a first dielectric layer (e.g., $Nb_2O_5$, 1.5 nm thick), a second dielectric layer (e.g., $Ta_2O_5$, 0.5 nm thick), and a second metal layer (e.g., Nb). Other materials and configurations are also contemplated. For the configuration including Nb as the first metal and the second metal, it may be desirable to form the antennas 310, 320, and the striplines 340, 350 with Nb for simplifying manufacturing. In another embodiment, the diode may be a metal-on-metal (MoM) diode. Such MoM devices include a thin barrier layer and an oxide layer sandwiched between two metal electrodes. A difference in the work function between the metal junctions results in high-speed rectification. Examples of MoM materials include Au—Si—Ti and InGaAs/InP. Other embodiments include an MIM diode, PN semiconductor materials, a metal-semiconductor junction (Schottky) diode, a Gunn diode (e.g., GaAs or InP), photodiodes, a PIN diode (i.e., a diode having a P-type region, an insulator region, an N-type region), and a geometric diode.

During operation of the energy conversion device 300, the energy conversion device 300 may be exposed to incident radiation 105, such as radiation provided by the sun or some artificial radiation source. The incident radiation 105 is not shown in FIG. 3A as this view is a top view and the incident radiation 105 would be normal (i.e., in the Z-direction) to the orientation of the shown in FIG. 3A. The antennas 310, 320 may absorb the incident radiation 105 and electromagnetically resonate causing surface currents (e.g., AC currents) to be produced. The antennas 310, 320 may be configured to absorb radiation at a range of frequencies to which the apparatus is exposed (e.g., radiation provided by the sun, thermal energy radiated by the earth, etc.). As discussed above, the antennas 310, 320 may be tuned to exhibit a particular resonant frequency or frequencies according to the desired range of radiation frequency or frequencies to be absorbed by the energy conversion device 300. By way of example and not limitation, the antennas 310, 320 may be configured to resonate at a frequency in one of the infrared (IR), near-IR, or visible light spectra. In one embodiment, the antennas 310, 320 may be configured to absorb radiation having a frequency of between approximately 20 THz and approximately 1,000 THz (i.e., at wavelengths between about 0.3 μm and about 15.0 μm), which corresponds generally to the visible to mid-infrared spectrum. In particular, tuning the antennas 310, 320 to resonate for radiation having wavelengths in the mid-infrared radiation region of 8 μm to 12 μm may enable capturing localized thermal radiation of objects at room temperature for a useful purpose. In addition, thermal radiation may be absorbed and converted into electric current, which may assist in reducing effects and discomforts of thermal heat of an object (e.g., battery, heating/cooling system), and energy conservation by harvesting the converted energy. In some embodiments, the range of desired absorbed wavelengths may be between 10 μm and 100 μm. Such a range of wavelengths may enable capturing heat from industrial waste streams.

Figure 3B:
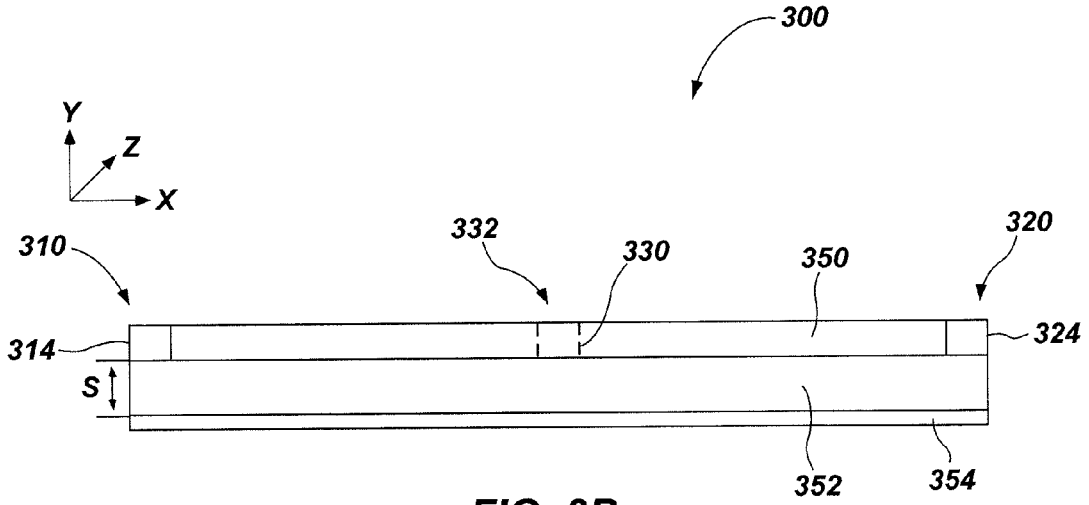
FIG. 3B is a cross-sectional view of the energy conversion device of FIG. 3A taken along section line 3B-3B.

FIG. 3B is a cross-sectional view of the energy conversion device 300 taken along the line 3B-3B of FIG. 3A. The cross-sectional view of FIG. 3B shows antennas 310, 320 (including the conductive elements 314, 324), the second stripline 350, and the rectifier 330 overlying a substrate 352. In some embodiments, the antennas 310, 320, the second stripline 350, and the rectifier 330 may be at least partially disposed (e.g., embedded) within the substrate 352. The substrate 352 may be further coupled with a ground plane 354. Because FIG. 3B is a side view, the conductive elements 312, 322 and first stripline 340 are positioned behind the elements shown and not in this view; however, it should be appreciated that a cross-sectional view from the opposite side would similarly show the conductive elements 312, 322 and first stripline 340, as well as the rectifier 330.

The ground plane 354 may be formed, for example, on a surface of the substrate 352 at a desired distance opposite from the antennas 310, 320. The distance (S) extending between the antennas 310, 320 and the ground plane 354 may be approximately equal to one quarter (¼) of a wavelength of an associated frequency at which the antennas 310, 320 are intended to resonate. This spacing forms what may be termed an "optical resonance gap" (i.e., an optical resonance standoff layer) between the antennas 310, 320 and the ground plane 354. The optical resonant gap may properly phase the electromagnetic wave for maximum absorption in the antenna plane.

The striplines 340, 350 may be formed of the same metal as the respective antenna 310, 320 to which it is coupled. For example, the first stripline 340 may be formed of the same metal as the first antenna 310, and the two may be integrally formed. Likewise, the second stripline 350 may be formed of the same metal as the second antenna 320, and may also be integrally formed. As discussed above, the rectifier 330 may include an MIIM diode having two different metals to cause the conversion process to DC current. In other words, the two metals of the MIIM diode may have at least one different characteristic affecting the work functions of the metals. For example, the two metals may be doped differently. For simplifying manufacturing, the first metal of the MIIM diode may be the same metal as the metal chosen for the first stripline 340, and the second metal of the MIIM diode may be the same metal as the metal chosen for the second stripline 350. As a result, some embodiments may include striplines 340, 350 that are formed from metals having different work functions.

In some embodiments, separation between striplines 340, 350 may be approximately 200 nm to allow sufficient space for placement of the rectifier 330. The thickness of the striplines 340, 350 may be between approximately 20 nm to 40 nm. As the spacing between the neighboring antennas 310, 320 increases, the AC current travels a greater distance to reach the rectifier 330, which may result in more attenuation of the AC current. To reduce this attenuation effect, the neighboring antennas 310, 320 may be positioned approximately 10 μm apart or less. The distance between the neighboring antennas 310, 320 is also the length of the striplines 340, 350. For an initial resonance design of 10 μm (tuned for a major thermal radiation peak), the conductive elements 312, 314, 322, 324 of the antennas 310, 320 may be approximately 5 μm in length.

The substrate 352 may include a semiconductor material. As non-limiting examples, the substrate 352 may include a semiconductor-based material including, for example, at least one of silicon, silicon-on-insulator (SOI), silicon-on-sapphire (SOS), doped and undoped semiconductor materials, epitaxial layers of silicon supported by a base semiconductor foundation, and other semiconductor materials. In addition, the semiconductor material need not be silicon-based, but may be based on silicon-germanium, germanium, or gallium arsenide, among others. Semiconductor materials, such as amorphous silicon, may exhibit electrical conductivity behavior that influences the behavior of the antennas 310, 320. In particular, the resonance frequency and bandwidth of the antennas 310, 320 is a partial function of the impedance of the substrate 352. The semiconductor material of the substrate 352 may be doped to tune the semiconductor material to enhance performance of the antennas 310, 320.

Alternatively or additionally, the substrate 352 may comprise a dielectric material. For example, the substrate 352 may comprise a flexible material selected to be compatible with energy transmission of a desired wavelength, or range of wavelengths, of electromagnetic radiation (i.e., light). The substrate 352 may be formed from a variety of flexible materials, such as a thermoplastic polymer or a moldable plastic. For example, the substrate 352 may comprise polyethylene, polypropylene, acrylic, fluoropolymer, polystyrene, poly methylmethacrylate (PMMA), polyethylene terephthalate (MYLAR®), polyimide (e.g., KAPTON®), polyolefin, or any other material chosen by one of ordinary skill in the art. Providing such a flexible substrate may enable integration of the energy conversion device 300 into existing infrastructures. In additional embodiments, the substrate 352 may comprise a binder with nanoparticles distributed therein, such as silicon nanoparticles distributed in a polyethylene binder, or ceramic nanoparticles distributed in an acrylic binder. Any type of substrate 352 may be used that is compatible with the transmission of electromagnetic radiation of an anticipated wavelength. Additionally, the substrate 352 may exhibit a desired permittivity to enable concentration and storage of electrostatic lines of flux. Dielectric materials used as the substrate 352 may also exhibit polarization properties. For example, the dielectric materials used as the substrate 352 may be polarized as a function of the applied electromagnetic field. As a result, the index of refraction and permittivity of the energy conversion device 300 may be tuned, which results in a material dispersion and a frequency-dependent response for wave propagation. Properly phasing the radiation may improve capture efficiency of the antennas 310, 320.

In one embodiment, the energy conversion device 300 may include a substrate 352 formed of polyethylene with the antennas 310, 320 formed of aluminum. It is noted that the use of polyethylene (or other similar material) as a substrate 352 provides the energy conversion device 300 with flexibility such that it may be mounted and installed on a variety of surfaces and adapted to a variety of uses.

Other configurations, materials, and layers are contemplated, such as providing cavities within the substrate 352 between the antennas 310, 320 and the ground plane 354, and providing a protective layer over the antennas 310, 320, examples of which are described in U.S. Pat. No. 8,071,931, entitled "Structures, Systems and Methods for Harvesting Energy from Electromagnetic Radiation," and issued Dec. 6, 2011, the entire disclosure of which is incorporated herein by this reference.

Components of the energy conversion device 300 may further be impedance matched to ensure maximum power transfer between components, to minimize reflection losses, and to achieve THz switch speeds. Impedance matching may be improved by coupling the neighboring antennas 310, 320 with the co-planar striplines 340, 350, and to the common rectifier 330. As a result, the impedance matching of the neighboring antennas 310, 320 may match both the real part of the impedance and the imaginary part of the impedance (i.e., conjugate impedance matching) by controlling some of the load characteristics and dimensions of the various components of the energy conversion device 300. For example, the location of the rectifier 330 along the length of the striplines 340, 350 may contribute to the matching of the complex impedance elements of the energy conversion device 300.

Also, as shown in FIG. 3B, each of the antennas 310, 320 (including the conductive elements 314, 324), the second stripline 350, and the rectifier 330 are co-planar in the XZ plane, and parallel with the XZ plane of the underlying substrate 352. This co-planar configuration may also reduce impedance mismatch in comparison to conventional multi-plane devices in which a rectifier is offset below an antenna.

Figure 4:
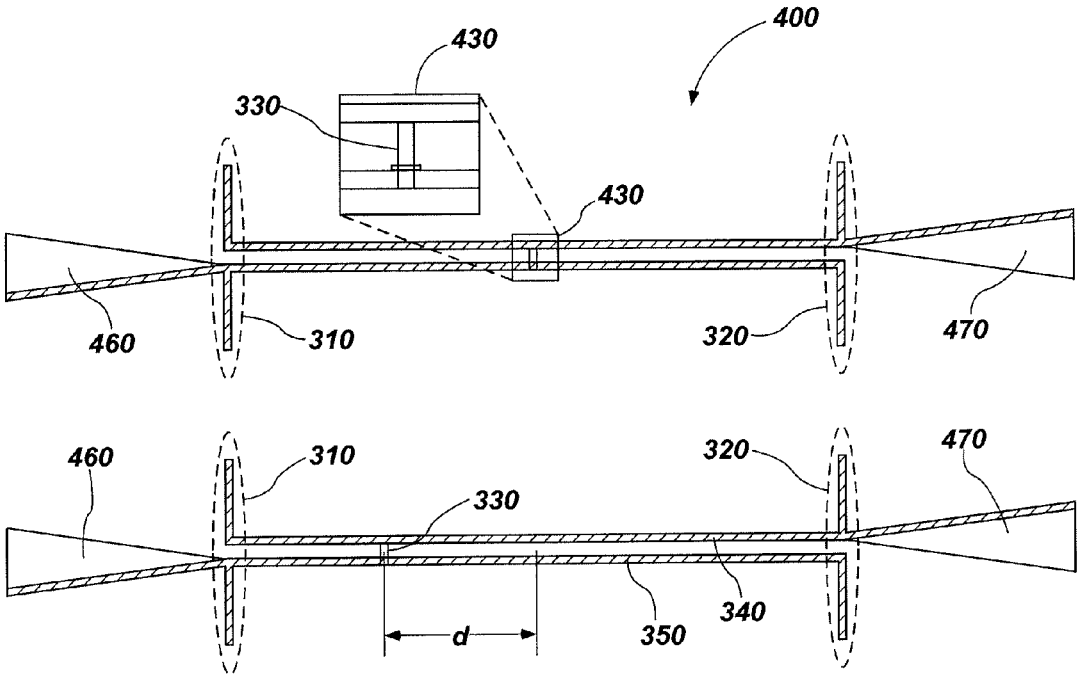
FIG. 4 is an energy conversion device according to an embodiment of the present disclosure.

FIG. 4 is an energy conversion device 400 according to an embodiment of the present disclosure. The energy conversion device 400 includes a plurality of antennas 310, 320 configured as described above with respect to FIGS. 3A and 3B. In particular, a pair of antennas 310, 320 may be coupled together through striplines 340, 350, having a common rectifier 330 coupled at a feedpoint 430 along a length of the striplines 340, 350. The length of striplines 340, 350 may be approximately the same for the top pair of antennas 310, 320 and for the bottom pair of antennas 310, 320. The energy conversion device 400 may further include electrical leads 460, 470 coupled to the antennas 310, 320 such that the DC current is further sent to a bus structure (FIG. 5) for collection and energy harvesting. Thus, the top pair of antennas 310, 320 and the bottom pair of antennas 310, 320 may be a portion of an array of antennas that couple to a common bus structure. One antenna (e.g., antenna 310) may couple to a local bus for the anode, and the other antenna (e.g., antenna 320) may couple to a local bus for the cathode to provide the DC signal output of the energy conversion device 400.

When coupling a pair of neighboring antennas 310, 320 together, the AC signals generated by each antenna 310, 320 may be out of phase with each other, causing destructive interference and energy loss. As a result, the efficiency of the energy conversion device 400 may be reduced because the amount of energy transmitted may be reduced. Matching the complex impedance of the antennas 310, 320 may result in a purely resistive load that reduces or eliminates the harmonics and out-of-phase components of the AC signals that would otherwise cause destructive interference. As a result, an increased power transfer and higher efficiency may be achieved. Having a common rectifier 330 may provide additional flexibility to tune the system and provide impedance matching.

As shown in FIG. 4, the top pair of antennas 310, 320 includes the rectifier 330 being located approximately at the midpoint along the length of the striplines 340, 350 between the antennas 310, 320. The bottom pair of antennas 310, 320, however, includes the rectifier 330 being located at a position that is offset from the midpoint by some distance (d).

In comparison to conventional energy harvesting devices that may position a rectifier directly at the base of a single antenna, embodiments of the present disclosure that position the common rectifier 330 at a location along the striplines 340, 350 may provide a designer with additional degrees of freedom to achieve complex impedance matching between the antennas 310, 320 and the rectifier 330. The coupling efficiency and attenuation constant of the striplines 340, 350 may be determined by the stripline separation and substrate material. The position of the rectifier 330 relative to the antennas 310, 320 also determines the phase shift between the generated AC currents, further enabling tuning and other control over complex reactance. For example, as shown in FIG. 4, the common rectifier 330 may be moved off center between the neighboring antennas 310, 320. As a result, the rectifier 330 may be closer to one of the antennas (e.g., the first antenna 310) than the other of the antennas (e.g., the second antenna 320).

Antennas 310, 320 may be impacted by the surrounding environment, including other neighboring antennas. For example, having an array of antennas 310, 320 may have an effect over the resonant frequencies of the antennas 310, 320 that might not be the case if the antennas 310, 320 were merely in isolation. In other words, the characteristics of a single antenna pair 310, 320 might be different than if that same antenna pair 310, 320 were placed in a large group (e.g., array) of antennas. When forming arrays of antennas, the neighboring antennas 310, 320 may be coupled together with differential striplines 340, 350 and a common rectifier 330 to compensate for the surrounding environment. As a result, the antennas 310, 320 may be coupled in a differential mode such that the antennas 310, 320 may exhibit a different point of resonance than other antennas 310, 320 in the array. For example, even though the striplines 340, 350 are substantially the same length from one antenna pair 310, 320 to the next for the array, the relative location of the rectifier 330 may be adjusted from pair to pair to adjust the resonant frequency for the overall system. During the design of the overall system, numerical modeling may be performed for characterization of antennas 310, 320 and striplines 340, 350 of an array at IR frequencies, and to finalize a design.

Figure 5:
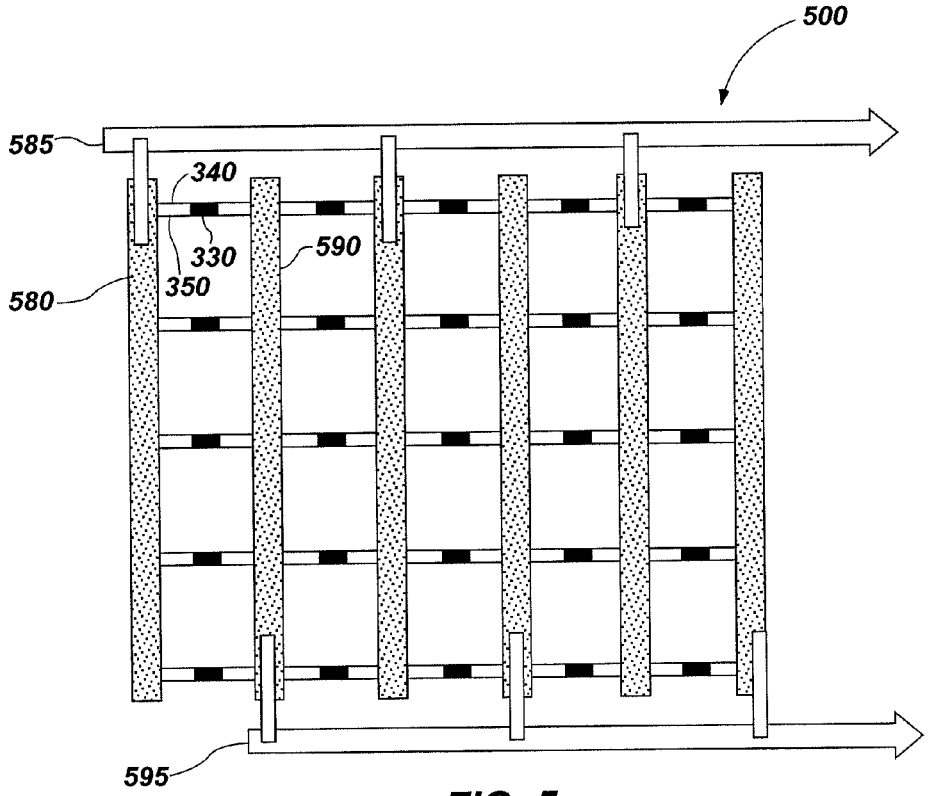
FIG. 5 is a schematic diagram of an energy conversion device according to an embodiment of the present disclosure.

FIG. 5 is an energy conversion device 500 according to an embodiment of the present disclosure. The energy conversion device 500 includes a plurality of antennas 310, 320 configured as described above with reference to FIGS. 3A, 3B, and 4. The plurality of antennas 310, 320 may be arranged in a periodic arrangement (e.g., an array). Such a periodic arrangement of antennas 310, 320 may form an NEC structure (e.g., an FSS).

The plurality of antennas 310, 320 may be coupled to a common power bus structure for providing a DC output signal from the energy conversion device 500. For example, a first set of local busses 580 may provide a positive voltage, and a second set of local busses 590 may provide a negative voltage. As shown in FIG. 5, large antenna arrays may be implemented using a series/parallel bus design, which may eliminate a single point of failure if an individual antenna is damaged. The first set of local busses 580 may be coupled to a master positive power bus 585, and the second set of local busses 590 may be coupled to a master negative power bus 595. In other words, the first set of local busses 580 and the second set of local busses 590 may be local bus structures that are coupled with the array of nanoantennas to receive the DC current. The master positive power bus 585 and the master negative power bus 595 may be a master bus structure coupled with the local bus structure to transmit the DC current away from the array of nanoantennas. The master bus structures may be further coupled to a storage unit (not shown) for harvesting the energy.

The first set of local busses 580 and the second set of local busses 590 may run parallel with a group (e.g., columns, rows, etc.) of antennas 310, 320. The first set of local busses 580 and the second set of local busses 590 may alternate throughout the array. The master positive power bus 585 and the master negative power bus 595 may be positioned on the outer fringe of the array. The power bus structure may be co-planar with the arrays of antennas 310, 320 and the rectifiers 330, simplifying fabrication. This may eliminate the need for via feedthrough to another layer. However, some embodiments may include sub-array central power buses having different positions on different planes. In some embodiments, the ground plane 354 (FIG. 3B) may serve as the master negative power bus 595.

Each individual pair of antennas 310, 320 may be tuned to a particular resonant frequency according to the shape, dimensions, and materials of the conductive elements, with adjustments made from the location of the rectifier 330 for impedance matching or other fine tuning. Each pair of antennas 310, 320 may be tuned individually to form the collective array. A system approach may also be employed for tuning the array. For example, the overall environment may affect the tuning and impedance matching for the individual pairs of antennas 310, 320 when they are coupled together as an array. For example, even though the striplines 340, 350 are substantially the same length from one antenna pair 310, 320 to the next for the array, the relative location of the rectifier 330 may be adjusted from pair to pair to adjust the resonant frequency for the overall system. During the design of the overall system, numerical modeling may be performed for characterization of antennas 310, 320 and striplines 340, 350 of an array at the desired frequencies, and to finalize a design.

An array including a plurality of pairs of antennas 310, 320 coupled with a common rectifier 330 may also serve as an antenna reflector element to further shape and steer the beam patterns of the antennas. The amplitude and phase of the collected radiation may be manipulated to achieve directional reception of infrared radiation. As a result, performance may be further optimized by adjusting the phased-array antenna behavior. For example, at the antenna pair level (pixel level) the rectifier 330 may have a relative position that is different from antenna pair 310, 320 to antenna pair 310, 320 (pixel to pixel) throughout the array. As an example, the rectifier 330 may be placed closer to one antenna 310 than the other antenna 320, and then the relative position of rectifier 330 may be changed for the next antenna pair 310, 320 of the array (e.g., at steps of ±100 nm). As a result, the array and the bus structures may complement the antenna performance and provide some virtual beam steering.

The density of the antenna array may be selected to enable large-scale imprint manufacturing methods and to increase the amount of electromagnetic radiation captured by the array. The destructive interference of side lobe losses generally increase as the antenna spacing increases. Therefore, the maximum antenna spacing may be selected to simultaneously reduce propagation loss, reduce side lobe losses, and increase antenna array gain. As an example, the antenna array may include about 10 μm to 20 μm between adjacent antennas.

FIGS. 6A, 6B, 6C, 6D, 6E, and 6F are geometries of resonant elements 600A, 600B, 600C, 600D, 600E, and 600F according to embodiments of the present disclosure. Although FIGS. 1 through 5 show resonant elements configured as dipole antennas, other shapes and geometries are contemplated. In other words, while particular geometries are shown in FIGS. 6A, 6B, 6C, 6D, 6E, and 6F, additional geometries are contemplated, such as circular loops, concentric loops, circular spirals, slots, and crosses, among others.

Figure 6A:
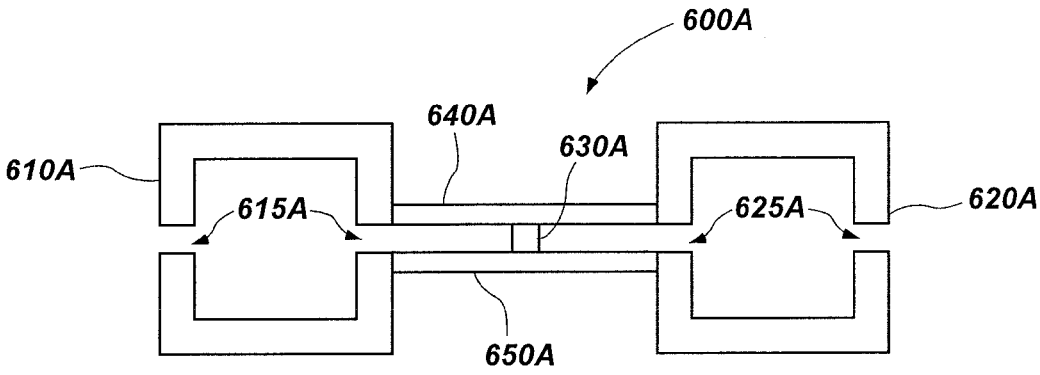
FIGS. 6A, 6B, 6C, 6D, 6E, and 6F illustrate geometries of resonant elements according to embodiments of the present disclosure.

FIG. 6A shows a resonant element 600A including neighboring antennas 610A, 620A configured as square loop antennas, and in particular a slot gap square loop antenna. The neighboring antennas 610A, 620A are coupled to a common rectifier 630A through striplines 640A, 650A. Each of the neighboring antennas 610A, 620A may include gaps 615A, 625A, respectively, to provide an open circuit with the rectifier 630A therebetween. The dimensions and placement of the gaps 615A, 625A may provide additional parameters for tailoring the real/imaginary impedance (conjugate match) to further increase power transfer at THz frequencies and reduce standing waves. In some embodiments, the gaps 615A, 625A may not be symmetrical on their respective antennas 610A, 620A. In addition, the gap 615A may have a different position and width on the antenna 610A than the position and width of the gap 625A on the antenna 620A. As a result, the position and size of each of the gaps 615A, 625A may enable further tuning of the capacitive reactance and effective impedance of the load of the antennas 610A, 620A by adjusting the electrical length and inductance of each of the antennas 610A, 620A. Having the gaps 615A, 625A being offset (i.e., non-symmetrical) may enable offsetting capacitive reactance with inductive reactance such that the complex impedance of the antennas 610A, 620A may become a real resistive load.

Figure 6B:
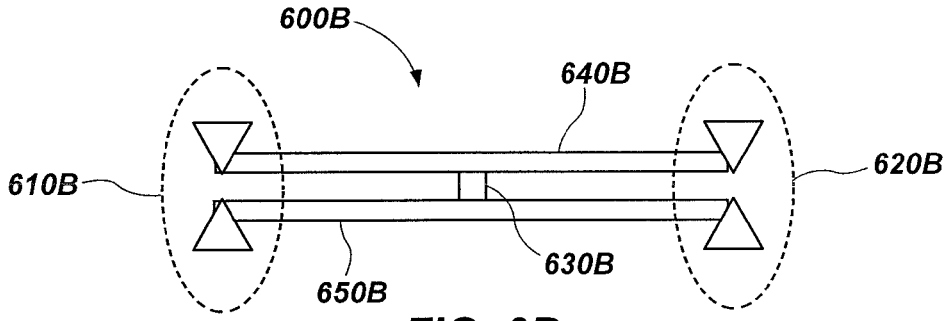
Figure 6C:
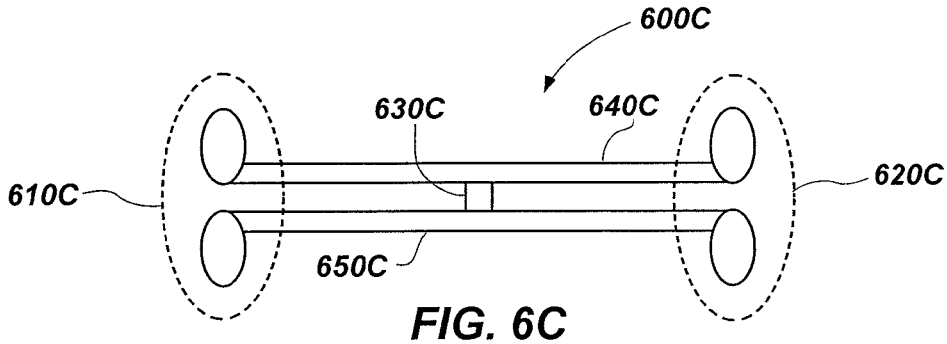

FIG. 6B shows a resonant element 600B including neighboring antennas 610B, 620B configured as bowtie antennas. The neighboring antennas 610B, 620B are coupled to a common rectifier 630B through striplines 640B, 650B. FIG. 6C shows a resonant element 600C including neighboring antennas 610C, 620C configured as oval-shaped dipole antennas. The neighboring antennas 610C, 620C are coupled to a common rectifier 630C through striplines 640C, 650C.

Figure 6D:
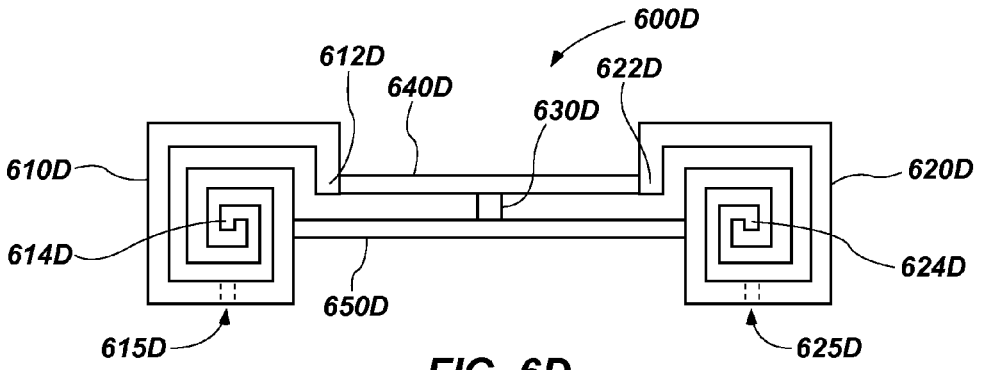

FIG. 6D shows a resonant element 600D including neighboring antennas 610D, 620D configured as square spiral antennas. The neighboring antennas 610D, 620D are coupled to a common rectifier 630D through striplines 640D, 650D. Each of the neighboring antennas 610D, 620D may include gaps 615D, 625D, respectively, to provide an open circuit with the rectifier 630D therebetween. The first stripline 640D may be coupled to first ends 612D, 622D of the antennas 610D, 620D, respectively. It is noted that, although the second stripline 650D is shown in FIG. 6D as terminating at an intermediate point of each of the antennas 610D, 620D, the second stripline 650D may be coupled to second ends 614D, 624D of the antennas 610D, 620D, respectively. As a result, the second stripline 650D may not be coplanar with the antennas 610D, 620D and the first stripline 640D. For simplicity, the portions of the second stripline 650D extending under the antennas 610D, 620D and coupled to second ends 614D, 624D are not depicted. To accommodate the different planes, feedthrough vias may be formed to couple the second ends 614D, 624D of the antennas 610D, 620D with the second stripline 650D. Likewise, a feedthrough via may be formed to couple the rectifier 630D to either the first stripline 640D or the second stripline 650D depending on the plane of the rectifier 630D.

Figure 6E:
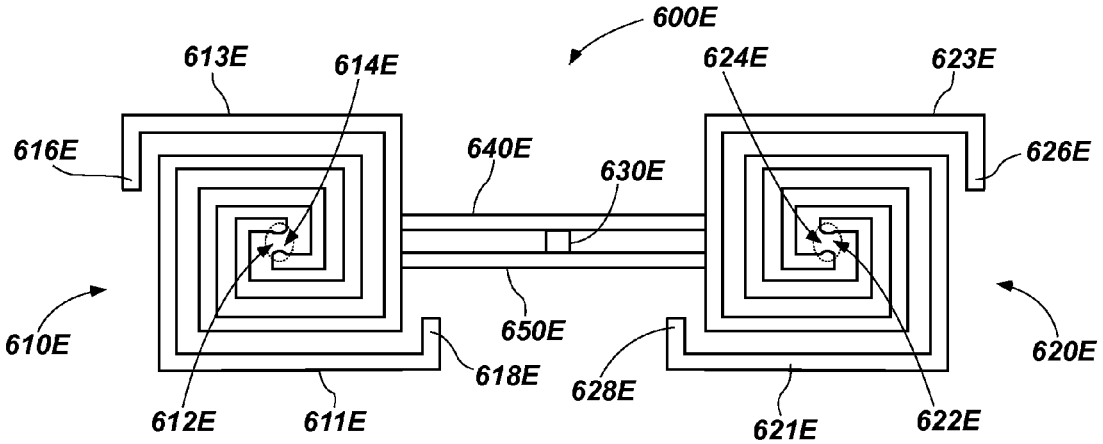

FIG. 6E shows a resonant element 600E including neighboring antennas 610E, 620E configured as alternating square spiral antennas. The neighboring antennas 610E, 620E are coupled to a common rectifier 630E through striplines 640E, 650E. The first antenna 610E may include two square spiral antennas 611E, 613E that interleave and spiral toward a center point. Likewise, the second antenna 620E may include two square spiral antennas 621E, 623E that interleave and spiral toward a center point. The first ends 612E, 622E of square spiral antennas 611E, 621E, respectively, may be coupled together by the first stripline 640E. The second ends 614E, 624E of square spiral antennas 613E, 623E, respectively, may be coupled together by the second stripline 650E. Similar to FIG. 6D, the striplines 640E, 650E are shown as terminating at intermediate points of the antennas 610E, 620E; however, it should be understood that the striplines 640E, 650E may extend below the antennas 610E, 620E such that they are not coplanar, which may require feedthrough vias to enable such coupling to the ends 612E, 622E, 614E, 624E. In an alternate embodiment, the striplines 640E, 650E may be coupled to the third ends 616E, 626E, and the fourth ends 618E, 628E, respectively.

Figure 6F:
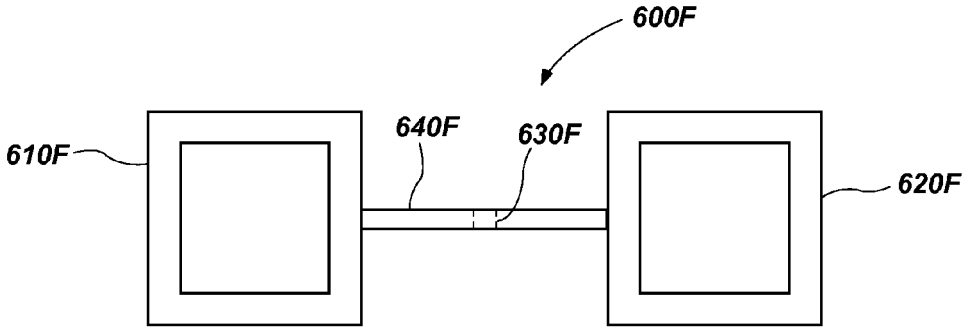

FIG. 6F shows a resonant element 600F including neighboring antennas 610F, 620F configured as square loop antennas. The neighboring antennas 610F, 620F are coupled to a common rectifier 630F through a single stripline 640F. The rectifier 630F is shown in dashed lines to indicate that the rectifier 630F may extend below the stripline 640F to another plane below the stripline 640F. For example, the rectifier 630F may extend from the stripline 640F to a conductive plate (not shown), such as a ground plane. For embodiments in which a plurality of resonant elements 600F may be used, each of the plurality of resonant elements 600F may include the common rectifiers 630F to couple with a common conductive plate (e.g., ground plane). Such an embodiment may reduce the feature size of the resonant element 600F by employing a single stripline 640F rather than two; however, at least some of the elements may not be coplanar, which may further require feedthrough vias for coupling.

CONCLUSION

Embodiments of the present disclosure include an energy conversion device. The energy conversion device comprises a first antenna, a second antenna, at least one stripline coupling the first antenna and the second antenna, and a rectifier coupled with the at least one stripline along a length of the at least one stripline. The first antenna and the second antenna are each configured to generate an AC current responsive to incident radiation.

Another embodiment of the present disclosure includes an array of nanoantennas configured to generate an AC current in response to receiving incident radiation and a bus structure operably coupled with the array of nanoantennas. Each nanoantenna of the array includes a pair of resonant elements, and a shared rectifier operably coupled to the pair of resonant elements, the shared rectifier configured to convert the AC current to a DC current. The bus structure is configured to receive the DC current from the array of nanoantennas and transmit the DC current away from the array of nanoantennas.

Another embodiment of the present disclosure includes a method of forming an energy conversion device. The method comprises forming a pair of conductive nanoantennas coupled with a substrate, forming at least one stripline coupling the pair of conductive nanoantennas, and forming a rectifier along a length of the at least one stripline.

While the present disclosure has been described herein with respect to certain illustrated embodiments, those of ordinary skill in the art will recognize and appreciate that the present invention is not so limited. Rather, many additions, deletions, and modifications to the illustrated and described embodiments may be made without departing from the scope of the invention as hereinafter claimed along with their legal equivalents.

What is claimed is:

1. An energy conversion device, comprising:

a first antenna;

a second antenna;

wherein the first antenna and the second antenna are each configured to generate an AC current responsive to incident radiation;

at least one stripline coupling the first antenna and the second antenna; and a rectifier coupled with the at least one stripline along a length of the at least one stripline, the rectifier being a common rectifier for the first antenna and the second antenna for the AC current to flow therefrom to the rectifier for rectification.

2. The energy conversion device of claim 1, wherein the at least one stripline comprises a pair of parallel striplines having the rectifier coupled therebetween.

3. The energy conversion device of claim 1, wherein the first antenna and the second antenna are dipole antennas.

4. The energy conversion device of claim 3, wherein the dipole antennas each include conductive elements separated by a space.

5. The energy conversion device of claim 4, wherein the conductive elements are elongated and collinear with respect to each other.

6. The energy conversion device of claim 4, wherein the conductive elements have a shape selected from the group consisting of a circular shape, an oval shape, a square shape, a bowtie shape, and a triangular shape.

7. The energy conversion device of claim 1, wherein the first antenna and the second antenna are loop antennas.

8. The energy conversion device of claim 1, further comprising an underlying substrate over which the first antenna, the second antenna, the at least one stripline, and the rectifier are formed.

9. The energy conversion device of claim 8, further comprising a ground plane coupled with the underlying substrate on a surface of the underlying substrate opposite the first antenna, the second antenna, the at least one stripline, and the rectifier.

10. The energy conversion device of claim 8, wherein the first antenna, the second antenna, the at least one stripline, and the rectifier are all co-planar in a plane that is parallel to a plane of the underlying substrate.

11. The energy conversion device of claim 1, wherein the rectifier is coupled proximate to the middle of the length of the at least one stripline.

12. The energy conversion device of claim 1, wherein the rectifier is coupled along the length of the at least one stripline more proximate to the first antenna.

13. An energy conversion device, comprising:

an array of nanoantennas configured to generate an AC current in response to receiving incident radiation, wherein each nanoantenna of the array includes:

a pair of resonant elements; and a shared rectifier operably coupled to the pair of resonant elements, the shared rectifier configured to convert the AC current to a DC current for its pair of resonant elements; and a bus structure operably coupled with the array of nanoantennas and configured to receive the DC current from the array of nanoantennas and transmit the DC current away from the array of nanoantennas.

14. The energy conversion device of claim 13, wherein each nanoantenna of the array further includes a stripline coupling the pair of resonant elements and the shared rectifier.

15. The energy conversion device of claim 14, wherein the shared rectifier is located along a length of the stripline at a position that matches impedance of the pair of resonant elements.

16. The energy conversion device of claim 14, wherein the shared rectifier of one nanoantenna of the array has a relative position along a length of its corresponding stripline that is different than a relative position of another shared rectifier of another nanoantenna of the array to its corresponding stripline.

17. The energy conversion device of claim 13, wherein the pair of resonant elements and the shared rectifier are co-planar.

18. The energy conversion device of claim 17, wherein the bus structure is co-planar with the pair of resonant elements and the shared rectifier.

19. The energy conversion device of claim 13, wherein the bus structure includes:

a local bus structure coupled with the array of nanoantennas to receive the DC current; and a master bus structure coupled with the local bus structure to transmit the DC current away from the array of nanoantennas.

20. The energy conversion device of claim 13, wherein the rectifier includes a diode.

21. The energy conversion device of claim 20, wherein the diode is a metal-insulator-metal diode.

22. The energy conversion device of claim 13, wherein the bus structure includes a positive power bus and a negative power bus.

23. The energy conversion device of claim 22, wherein the negative bus is a ground plane coupled with a substrate underlying the array of nanoantennas.

24. A method of forming an energy conversion device, the method comprising:

forming a pair of conductive nanoantennas coupled with a substrate;

forming at least one stripline coupling the pair of conductive nanoantennas; and forming a rectifier along a length of the at least one stripline as a common rectifier for the pair of conductive nanoantennas.

25. The method of claim 24, wherein forming the pair of conductive nanoantennas, the at least one stripline, and the rectifier includes forming each of the pair of conductive nanoantennas, the at least one stripline, and the rectifier to be co-planar with each other and parallel to the substrate.

* * * * *